US010161666B2

(12) United States Patent
Kim

(10) Patent No.: US 10,161,666 B2
(45) Date of Patent: Dec. 25, 2018

(54) COOL AIR PATH DAMPER ASSEMBLY WITH ELASTIC ANTI-FREEZING MEMBER

(71) Applicant: Dongbu Daewoo Electronics Corporation, Seoul (KR)

(72) Inventor: Hyo Su Kim, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 90 days.

(21) Appl. No.: 14/881,119

(22) Filed: Oct. 12, 2015

(65) Prior Publication Data

US 2016/0370093 A1 Dec. 22, 2016

(30) Foreign Application Priority Data

Jun. 17, 2015 (KR) ..... 10-2015-0086139

(51) Int. Cl.
*F25D 17/04* (2006.01)
*F25D 21/04* (2006.01)

(52) U.S. Cl.
CPC ..... *F25D 17/045* (2013.01); *F25D 21/04* (2013.01); *F25D 2400/02* (2013.01); *F25D 2400/06* (2013.01)

(58) Field of Classification Search
CPC ..... F25D 17/045; F25D 2400/06; F25D 2400/02; F25D 21/04; F25D 17/065; F25D 17/08; F25D 17/042; F25D 2317/063; F24F 13/15; F24F 13/16; F24F 13/18; F24F 13/10; F24F 13/105; F24F 13/12; F24F 13/14; F24F 13/1406; F24F 13/1413; F24F 13/142; F24F 13/1426; F24F 13/1486; F24F 2013/1433; F24F 2013/144; F24F 2013/1446; F24F 2013/1453; F24F 2013/146; F24F 2013/1466; F24F 2013/1473; F24F 2013/148; F24F 2013/1493; F24F 13/22
See application file for complete search history.

(56) References Cited

U.S. PATENT DOCUMENTS 1,982,079 A * 11/1934 Spohr ..... F25D 11/003 165/202
2,098,724 A * 11/1937 Hokanson ..... F25D 17/045 62/265

(Continued)

FOREIGN PATENT DOCUMENTS

CN 204100692 U 1/2015
KR 10-2003-0030742 A 4/2003

(Continued)

*Primary Examiner* — Frantz Jules
*Assistant Examiner* — Nelson Nieves

(57) ABSTRACT

A refrigerator having a cool air path damper assembly that can remove dew from the damper housing when the cool air path damper opens and closes. The damper assembly has an anti-freezing pad attached to its upper surface. An elastic anti-freezing member is inserted into the anti-freezing pad. The elastic anti-freezing member moves with the damper when the damper switches between an open and a closed state. During such a motion, the elastic anti-freezing member sweeps through the interior surface of the housing and thereby removes moisture from the interior surface. This can prevent ice formation on the damper due to rapid temperature drop when the damper opens.

13 Claims, 5 Drawing Sheets

(56) References Cited

U.S. PATENT DOCUMENTS 2,562,057 A * 7/1951 Norberg ..... F25D 11/02 220/592.06
2,562,446 A * 7/1951 Carson ..... F25D 17/062 62/408
4,116,213 A * 9/1978 Kamezaki ..... F24F 11/043 137/360
4,180,093 A * 12/1979 Kamezaki ..... F16K 17/18 137/341
4,852,361 A * 8/1989 Oike ..... F25D 17/045 62/131
5,460,010 A * 10/1995 Kobayashi ..... F25D 17/045 62/153
6,125,641 A * 10/2000 Kim ..... F25D 17/045 62/187
6,336,339 B1 * 1/2002 Joung ..... F25D 17/045 62/186
2004/0060319 A1 * 4/2004 Wood ..... B65D 88/126 62/441
2006/0168990 A1 * 8/2006 Park ..... F25D 17/045 62/408
2006/0277934 A1 * 12/2006 Cho ..... F25D 17/047 62/285
2008/0047294 A1 2/2008 Hasegawa
2008/0307807 A1 * 12/2008 Graff ..... F25D 17/045 62/186
2009/0113906 A1 * 5/2009 Talley ..... F25D 17/045 62/187
2013/0098078 A1 * 4/2013 Contreras Lafaire ... F25D 21/06 62/82
2014/0208783 A1 * 7/2014 Lee ..... F25D 17/045 62/89
2015/0052932 A1 * 2/2015 Allard ..... F25D 17/065 62/408

FOREIGN PATENT DOCUMENTS

KR 3892015 12/2006
KR 10-0918444 9/2009
WO WO 2012140854 A1 * 10/2012 ..... F25D 17/065

* cited by examiner

COOL AIR PATH DAMPER ASSEMBLY WITH ELASTIC ANTI-FREEZING MEMBER

CROSS REFERENCE

This patent application claims priority to and benefit of Korean Patent Application No. 10-2015-0086139, filed on Jun. 17, 2015, the content of which is incorporated herein by reference for all purposes.

FIELD OF THE INVENTION

Embodiments of the present invention relate to refrigerators, and more particularly, to cool air path dampers in refrigerators.

BACKGROUND OF THE INVENTION

Refrigerators are electrical appliances capable of maintaining a storage chamber below room temperature. Food can be stored in a refrigerator in a cold or frozen state.

The internal space of a refrigerator is maintained at a low temperature by cool air circulation. Cool air is generated through heat transfer of refrigerant through a cooling cycle, e.g., including compression, condensation, expansion, and evaporation. Cool air supplied into the refrigerator is distributed or circulated in the internal space of the refrigerator to achieve a desired temperature.

Typically, a main body of the refrigerator has a rectangular parallel-piped structure with doors installed on the front side. A refrigerating chamber and a freezer are enclosed in the main body, each having its own door. A plurality of drawers, trays, and/or storage boxes may be installed in the refrigerator, e.g., for sorting the stored food or other items.

A top-mount style refrigerator has a freezer disposed above a refrigerating space. In contrast, a bottom-freezer style refrigerator has a freezer disposed below a refrigerating space. Bottom-freezers style refrigerators have become increasingly popular. Generally users use the refrigerating space much more often than the freezer. A bottom-freezer style refrigerator provides more convenience to the user because its refrigerating space is disposed in the upper portion of the refrigerator and the user can easily access the refrigerating space without bending or otherwise lowering his or her body.

Typically, cool air is supplied from a freezer to a refrigerating chamber through a cool air discharge path. A damper is usually installed between the freezer and the refrigerating chamber for opening or closing the cool air path. For example, the damper can be installed inside a barrier (or wall) that separates the freezer and the refrigerating chamber from each other. The damper regulates air flow in the cool air path between the freezer and the refrigerating chamber. In general, the damper remains closed during a refrigeration cycle. The damper opens when the refrigerating chamber temperature rises above a threshold, which opens the cool air path for cool air to flow from the freezer to the refrigerating chamber.

When a damper is closed, dew tends to form around the damper (for example, a damper housing) due to the temperature difference between the freezer and the refrigerating chamber. When the damper opens to allow cool air to flow through, the temperature of the damper can be rapidly changed to a freezing point and causes the dewdrops around the damper to freeze into ice.

Conventionally, the damper uses a heater to remove the ice converted from dew. However, ice formed near the damper housing may not be immediately removed and unfortunately tends to interfere with the moveable parts of the damper when the damper switches from one state to another, e.g., open to closed or vice versa.

SUMMARY OF THE INVENTION

Therefore, it would be advantageous to provide a refrigerator which can reduce or eliminate any restrictions on the motion of the damper caused by ice formed on the cool air path.

Embodiments of the present invention provide a refrigerator including: a damper driving unit; a housing including a rotary shaft extending from the damper driving unit in the lengthwise direction; a damper rotated by the damper driving unit about the rotary shaft to open and close a cool air path; an anti-freezing pad attached to the upper surface of the damper in an area adjacent to the inner surface of the housing; and an anti-freezing member inserted into the anti-freezing pad. The anti-freezing member is configured to move with the damper and remove moisture formed on the inner surface of the housing when the damper switches from an open to a closed state, or vice versa.

In one embodiment, the anti-freezing member has a shape causing moisture removed from the inner surface of the housing to flow downwards along the anti-freezing member.

In one embodiment, the anti-freezing member is made of an elastic material, e.g., rubber or silicon.

In accordance with one embodiment present invention, a control method of a refrigerator includes: executing the refrigeration cycle of the refrigerator; sensing an inner temperature of the refrigerator; and opening a damper to unblock a cool air path between a freezer and a refrigerating chamber of the refrigerator when the inner temperature of the refrigerator is higher than a predetermined temperature. The anti-freezing member mounted on the upper surface of the damper removes dew condensation around a cool air path of the damper.

In one embodiment, the inner temperature is an inner temperature of the refrigerating chamber.

The foregoing is a summary and thus contains, by necessity, simplifications, generalizations and omissions of detail; consequently, those skilled in the art will appreciate that the summary is illustrative only and is not intended to be in any way limiting. Other aspects, inventive features, and advantages of the present invention, as defined solely by the claims, will become apparent in the non-limiting detailed description set forth below.

BRIEF DESCRIPTION OF THE DRAWINGS

Embodiments of the present invention will be better understood from a reading of the following detailed description, taken in conjunction with the accompanying drawing figures in which like reference characters designate like elements and in which.

DETAILED DESCRIPTION OF THE INVENTION

Figure 1:
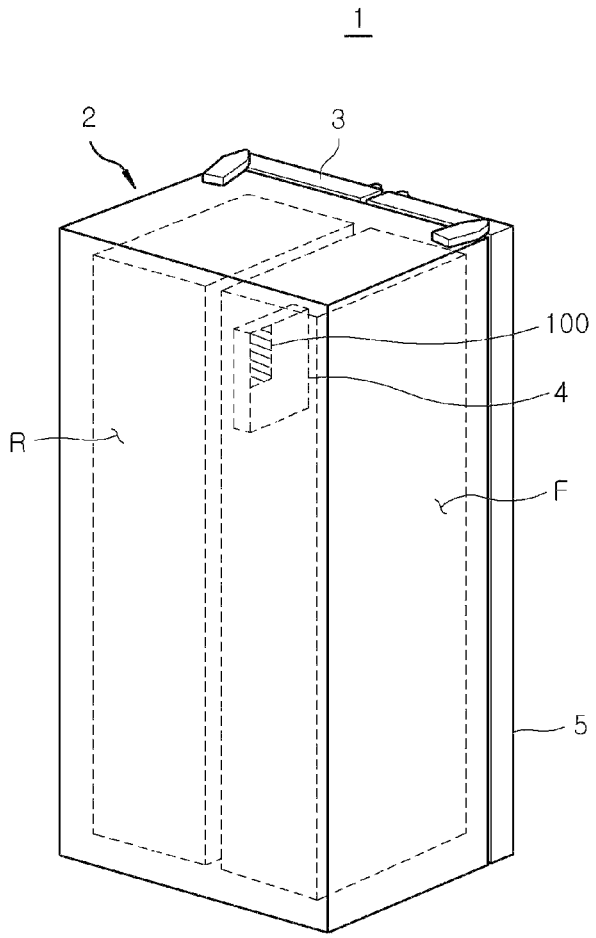
FIG. 1 is a perspective view of an exemplary refrigerator having a cool air path damper assembly in accordance with one embodiment of the present invention.

Reference will now be made in detail to the preferred embodiments of the present invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail so as not to unnecessarily obscure aspects of the embodiments of the present invention. The drawings showing embodiments of the invention are semi-diagrammatic and not to scale and, particularly, some of the dimensions are for the clarity of presentation and are shown exaggerated in the drawing Figures. Similarly, although the views in the drawings for the ease of description generally show similar orientations, this depiction in the Figures is arbitrary for the most part. Generally, the invention can be operated in any orientation.

Cool Air Path Damper Assembly with Elastic Anti-Freezing Member

FIG. 1 is a perspective view of an exemplary refrigerator having a cool air path damper assembly in accordance with one embodiment of the present invention.

As shown in FIG. 1, the refrigerator 1 includes a main body 2 forming the frame and housing of the refrigerator 1, a barrier 4 dividing the internal storage space of the refrigerator into a refrigerating chamber R and a freezer F. A refrigerating chamber door 3 and a freezer door 5 are coupled to the main body 2.

Here, a cool air path damper assembly 100 in accordance with one embodiment of the present invention may be installed in or on the barrier 4. The damper assembly 100 can control an opening in the cool air path between the freezer F and the refrigerating chamber R.

In a conventional refrigerator in which cool air from a freezer can be introduced into a refrigerating chamber through a cool air discharge path, a damper is used between the freezer and the refrigerating chamber. The damper is maintained at a closed state during a refrigeration cycle. When the temperature in the refrigerating chamber rises above a prescribed temperature, the damper opens such that a cool air path is formed to allow cool air to flow from the freezer to the refrigerating chamber.

Typically, a cooling system for generating cool air in the refrigerator includes a compressor, a condenser, an expansion valve, an evaporator, and etc, which are not shown in FIG. 1. The cooling system generates cool air through heat exchange between a refrigerant and air.

Figure 2:
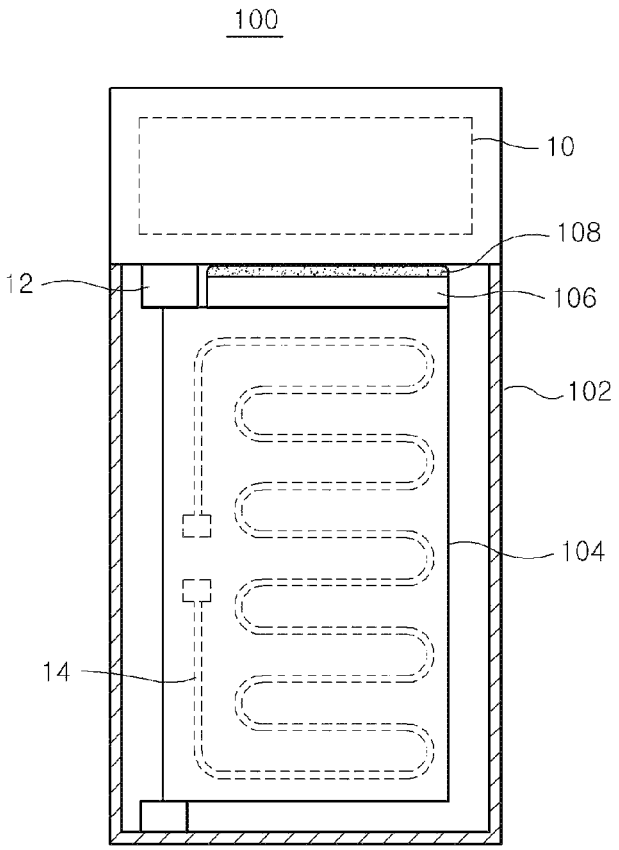
FIG. 2 illustrates the configuration of the exemplary damper assembly used in a cool air path in accordance with an embodiment of the present disclosure.

FIG. 2 illustrates the configuration of the exemplary damper assembly 100 used in a cool air path in accordance with an embodiment of the present disclosure. The damper assembly 100 includes a housing 102 and a damper 104, a driving unit 10, a rotary shaft 12 and the like may be provided in the housing 102. An anti-freezing pad 106 and an anti-freezing member 108 are disposed at the upper end of the damper 104. It will be understood that, in some other embodiments, the anti-freezing pad 106 and the anti-freezing member 108 may be disposed on the left or right side or the lower end of the damper 104, depending where dew condensation likely occurs.

Figure 3:
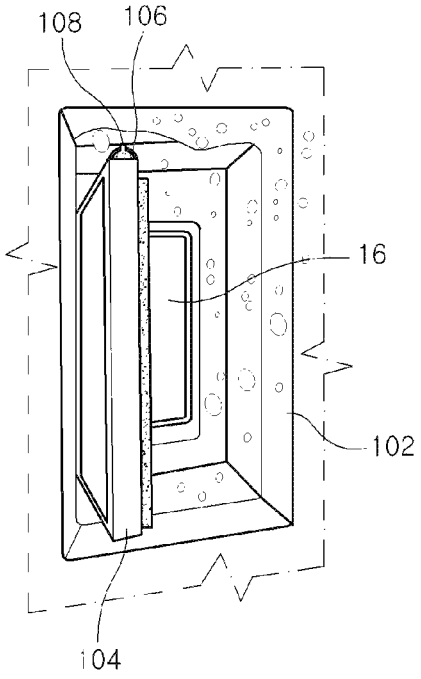
FIG. 3 illustrates an exemplary cool air path damper assembly with the damper being in an open position in accordance with an embodiment of the present disclosure.
Figure 4:
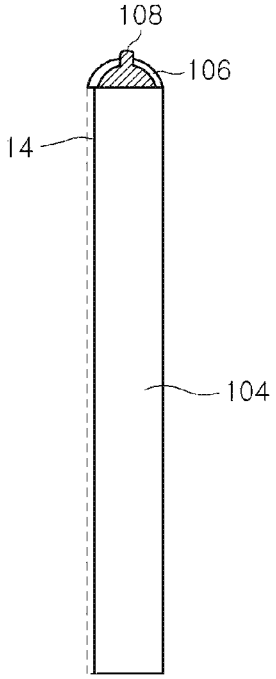
FIG. 4 shows the configuration of the damper in FIGS. 2 and 3 including an anti-freezing pad and an anti-freezing member in accordance with an embodiment of the present invention.

FIG. 3 illustrates the exemplary cool air path damper assembly 100 with the damper 104 in an open position in accordance with an embodiment of the present disclosure. FIG. 4 shows the configuration of the damper 104 in FIGS. 2 and 3 having the anti-freezing pad 106 and the anti-freezing member 108 mounted in accordance with an embodiment of the present invention.

As shown in FIG. 2, the housing 102 of the damper assembly 100 contains a coupling structure for receiving the damper 104, the damper driving unit 10 for rotating the damper 104, and the rotary shaft 12 coupled between the driving unit 10 and the damper 104. The rotary shaft 12 extends from the damper driving unit 10 in the lengthwise direction of the damper 104.

The damper driving unit 10 may be an electric motor, a solenoid, an actuator or the like. Driven by the damper driving unit 10, the damper 104 rotates about the rotary shaft 12 to open or close.

The anti-freezing pad 106 and the anti-freezing member 108 are disposed at the upper end of the damper 104 in this embodiment.

The anti-freezing pad 106 serves to attach the anti-freezing member 108 to the upper surface of the damper 104.

The anti-freezing member serves to remove moisture formed on the damper 104, especially the area near the damper assembly housing 102 when the damper 104 opens or closes.

For example, when the damper 104 is closed, the freezer F and the refrigerating chamber R are thermally insulated from each other by the barrier 4. Thus, dew condensation may occur around the damper 104 due to the temperature difference between the refrigerating chamber R and the freezer F, such as in an area proximate to the upper surface of the damper 104 and on the housing 102.

If the damper 104 opens (as shown in FIG. 3), the temperature of the damper 104 around the cool air path opening 16 may rapidly decrease. The rapid cooling may cause dewdrops that have formed on the damper 104 to freeze into ice.

According to embodiments of the present invention, when the damper 104 opens or closes, the anti-freezing member 108 can sweep across the inner surface of the housing 102 and thereby remove moisture formed on there. For example, when the damper moves, the anti-freezing member 108 moves with the damper and can touch an area of the housing that faces the upper surface of the damper 104. By removing the moisture, ice formation on the damper 104 can be advantageously and effectively prevented.

As shown in FIG. 4, the anti-freezing pad 106 is disposed on the upper surface of the damper 104 and serves to couple the anti-freezing member 108 to the damper 104.

The anti-freezing member 108 may have be funnel-shaped and inserted in the anti-freezing pad 106. The funnel shape allows moisture swept formed on the inner surface of the housing 102 to flow downwards along the anti-freezing member 108 under gravity, thus removing the moisture.

Such an anti-freezing member 108 may be made of an elastic material, for example, rubber or silicon. The anti-freezing member 108 may be mounted on the damper 104 adjacent to the inner surface of the housing 102. The anti-freezing member 108 can remove moisture formed on the inner surface of the housing 102 as the damper 104 opens or closes.

An electric heater 14 may be further provided on the front surface of the damper 104 to prevent restriction of damper motions caused by freezing. Here, the electric heater 14 may be a small-capacity heater having a small heating value in consideration of power consumption and freezing load. That is, the electric heater 14 is configured to have a heating capacity just to prevent restriction of the damper 104 motions caused by freezing. Further, power may be supplied to the electric heater 14 constantly or periodically.

Figure 5:
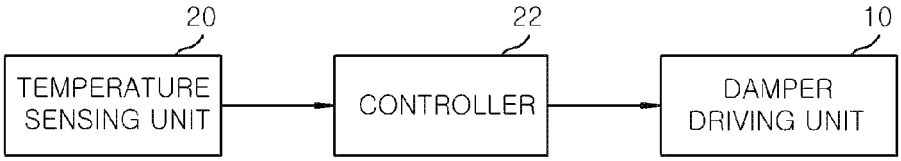
FIG. 5 is a functional block diagram of an exemplary control system for controlling a damper in a cool air path damper assembly in accordance with the embodiment of the present invention.

FIG. 5 is a functional block diagram of an exemplary control system for controlling the damper 104 (of the cool air path damper assembly 100) in accordance with the embodiment of the present invention. The system may include a temperature sensing unit 20, a controller 22 and the damper driving unit 10.

As exemplarily shown in FIG. 5, the temperature sensing unit 20 may be installed in the refrigerator 1 to sense the temperatures of the freezer F and the refrigerating chamber R, and to inform the sensed temperatures to the controller 22.

The controller 22 may compare a sensed temperature with a predetermined temperature. If the sensed temperature is higher than the predetermined temperature, the controller 22 issues a damper driving command to the damper driving unit 10.

Responsive to the damper driving command, the damper driving unit 10 rotates the rotary shaft 12 through an electric motor or an actuator to open or close the damper 104.

Figure 6:
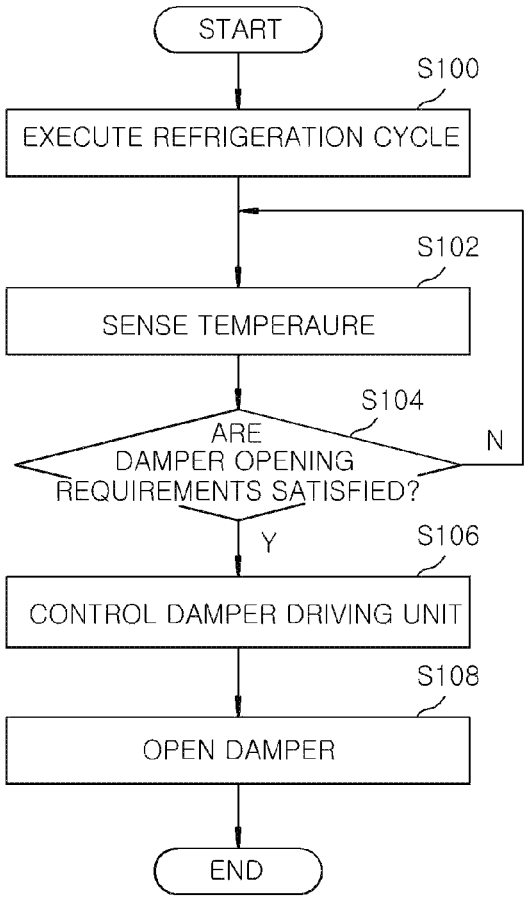
FIG. 6 depicts an exemplary process of controlling the refrigerator equipped with a cool air path damper assembly in accordance with an embodiment of the present invention.

FIG. 6 depicts an exemplary process of controlling the refrigerator 1 having the cool air path damper assembly 100 in accordance with an embodiment of the present invention.

As shown in FIG. 6, when a refrigeration cycle of the refrigerator 1 is executed (at S100), the controller 22 may receive temperature data sensed by the temperature sensing unit 20 (at S102).

After the temperature data is received by the controller 22, the controller 22 may determine whether the sensed temperature of the refrigerating chamber R is greater than predetermined temperature (at S104). If yes, the controller 22 supplies a driving command to the damper driving unit 10 to open the damper 104 (at S106).

However, using a sensed temperature of the refrigerating chamber R to control the damper 104 is only exemplary. Those skilled in the art will appreciate that various other types of information may be used to control the damper 104, such as a temperature difference between the freezer F and the refrigerating chamber R, the position (open or closed) of the refrigerating chamber door 3 or the freezer door 5, the frequency of opening or closing the doors 3 or 5 of the refrigerating chamber or the freezer, and/or etc.

Upon receiving the damper driving command sent from the controller 22, the damper driving unit 10 rotates the damper 104 through the rotary shaft 12 (at S108). As a result, the damper switches from an open state to a closed state, or vice versa.

According to the embodiments of the present disclosure, a cool air path damper assembly is capable of removing moisture (e.g., dew condensation) from a cool air path damper when the damper opens or closes. This advantageously prevents ice formation on or around the damper due to rapid temperature drop when the damper opens. As the motions of the damper would not be restricted by the ice formed thereon (as would occur in conventional refrigerators as described above), the damper can respond promptly to temperature changes in the refrigerator and thereby effectively maintain the refrigerating chamber at a desired temperature. Consequently, user experience on the refrigerator is achieved.

Although certain preferred embodiments and methods have been disclosed herein, it will be apparent from the foregoing disclosure to those skilled in the art that variations and modifications of such embodiments and methods may be made without departing from the spirit and scope of the invention. It is intended that the invention shall be limited only to the extent required by the appended claims and the rules and principles of applicable law.

What is claimed is:

1. A refrigerator comprising:

a damper disposed in a cool air path and operable to control a cool air conductance on the cool air path by moving between a first position and a second position;

a housing containing the damper;

an anti-freezing pad attached to an upper surface of the damper, wherein the anti-freezing pad includes an opening; and an anti-freezing member disposed on the damper, wherein the anti-freezing member is funnel-shaped and inserted into the anti-freezing pad such that a tip of the anti-freezing member is exposed toward an inner surface of the housing through the opening of the anti-freezing pad, wherein the tip of the anti-freezing member faces and contact with the inner surface of the housing when the damper is in the second position so that, when the damper moves between the first position and the second position, moisture formed on the inner surface of the housing flows downward along the anti-freezing member, and wherein the first position is an open position, and wherein the second position is a closed position.

2. The refrigerator according to claim 1 further comprising:

a rotary shaft coupled to the damper; and a damper driving unit coupled to the, rotary shaft and configured to rotate the damper between the first position and the second position.

3. The refrigerator according to claim 1, wherein the anti-freezing pad is configured to fasten the anti-freezing member onto the damper.

4. The refrigerator according to claim 1, wherein the anti-freezing member includes an elastic material.

5. The refrigerator according to claim 4, wherein the elastic material contains one of rubber and silicon.

6. A method of controlling a refrigerator, the method comprising:

executing a refrigeration cycle of the refrigerator;

sensing an inner temperature of the refrigerator by using a temperature sensing unit; and moving a damper between a first position and a second position, wherein the damper is disposed in a cool air path between a freezer and a refrigerating chamber of the refrigerator based on sensed inner temperature by using a controller, wherein an anti freezing member mounted on to the damper is operable to: move with the damper, wherein the anti-freezing member is funnel-shaped and inserted into an anti-freezing pad such that a tip of the anti-freezing member is exposed toward an inner surface of the housing through an opening of the anti-freezing pad, wherein the tip of the anti-freezing member faces and contacts with the inner surface of the housing when the damper is in the second position so that, when the damper moves between the first position and the second position, moisture formed on the inner surface of the housing flows downward along the anti-freezing member, and wherein the first position is an open position, and wherein the second position is a closed position.

7. The method according to claim 6, wherein the anti-freezing member is operable to prevent freezing of dew near and on the cool air path.

8. The method according to claim 6, wherein the inner temperature is an inner temperature of the refrigerating chamber of the refrigerator.

9. The method according to claim 6, wherein the anti-freezing member comprises an elastic material and is operable to sweep across the surface when moving with the damper.

10. The method according to claim 9, wherein the elastic material contains one of rubber and silicon.

11. A damper assembly comprising:

a damper configured to control cool air conductance on a cool air path of a refrigerator by moving between a first position and a second position;

a housing containing the damper;

an anti-freezing pad attached to an upper surface of the damper, wherein the anti-freezing pad includes an opening; and an elastic anti-freezing member disposed on the damper and configured to move with the damper, wherein the anti-freezing member is funnel-shaped and inserted into the anti-freezing pad such that a tip of the anti-freezing member is exposed toward an inner surface of the housing through the opening of the anti-freezing pad, wherein the tip of the anti-freezing member faces and contact with the inner surface of the housing when the damper is in the second position so that, when the damper moves between the first position and the second position, moisture formed on the inner surface of the housing flows downwards along the anti-freezing member by contacting the tip with the inner surface of the housing flows downward along the anti-freezing member, and wherein the first position is an open position, and wherein the second position is a closed position.

12. The damper according to claim 11 further comprising a driving motor configured to rotate the damper between the first position and the second position.

13. The damper according to claim 12, wherein the driving motor is configured to communicate with control logic in the refrigerator.

* * * * *